US011028673B2

(12) United States Patent
Arsalan et al.

(10) Patent No.: US 11,028,673 B2
(45) Date of Patent: Jun. 8, 2021

(54) THRU-TUBING OPERATIONS

(71) Applicants: Saudi Arabian Oil Company, Dhahran (SA); WIRELESS INSTRUMENTATION SYSTEMS AS, Trondheim (NO)

(72) Inventors: Muhammad Arsalan, Dhahran (SA); Jarl André Fellinghaug, Trondheim (NO)

(73) Assignees: Saudi Arabian Oil Company, Dhahran (SA); WIRELESS INSTRUMENTATION SYSTEMS AS, Trondheim (NO)

( * ) Notice: Subject to any disclaimer, the term of this patent is extended or adjusted under 35 U.S.C. 154(b) by 15 days.

(21) Appl. No.: 16/538,054

(22) Filed: Aug. 12, 2019

(65) Prior Publication Data

US 2020/0048994 A1 Feb. 13, 2020

Related U.S. Application Data

(60) Provisional application No. 62/718,061, filed on Aug. 13, 2018.

(51) Int. Cl.

| | |
|---|---|
| ***E21B 43/01*** | (2006.01) |
| ***E21B 17/10*** | (2006.01) |
| ***E21B 17/02*** | (2006.01) |

(52) U.S. Cl.

CPC ..... *E21B 43/01* (2013.01); *E21B 17/02* (2013.01); *E21B 17/1078* (2013.01)

(58) Field of Classification Search

CPC ..... E21B 43/01; E21B 17/02; E21B 17/1078; E21B 23/00

See application file for complete search history.

(56) References Cited

U.S. PATENT DOCUMENTS 4,685,523 A 8/1987 Paschal, Jr. et al.
5,566,762 A * 10/1996 Braddick ..... E21B 7/061 166/117.6

(Continued)

FOREIGN PATENT DOCUMENTS

WO WO 2018125071 7/2018

OTHER PUBLICATIONS

PCT International Search Report and Written Opinion in International Appln. No. PCT/US2019046272, dated Oct. 14, 2019, 16 pages.

(Continued)

*Primary Examiner* — Taras P Bemko
*Assistant Examiner* — Yanick A Akaragwe
(74) *Attorney, Agent, or Firm* — Fish & Richardson P.C.

(57) ABSTRACT

An apparatus and methods for using and deploying the same within a subterranean zone are described. The apparatus includes a conduit and an expandable mandrel positioned within the conduit. The conduit is configured to be positioned within a subterranean zone. The conduit has an inner surface and an outer surface. The conduit defines an opening extending from the inner surface to the outer surface. At least a portion of the expandable mandrel is smaller than the opening. A longitudinal length of the expandable mandrel is longer than a longitudinal length of the opening. The expandable mandrel, when actuated, is configured to move in a radial direction with respect to the conduit, such that the portion of the expandable mandrel smaller than the opening moves through the opening and extends beyond the outer surface of the conduit.

15 Claims, 7 Drawing Sheets

(56) References Cited

U.S. PATENT DOCUMENTS

| | | | | |
|---|---|---|---|---|
| 6,068,015 | A | 5/2000 | Pringle | |
| 6,082,455 | A | 7/2000 | Pringle et al. | |
| 2002/0043404 | A1 | 4/2002 | Trueman et al. | |
| 2008/0296067 | A1* | 12/2008 | Haughom | E21B 17/1014 175/325.4 |
| 2009/0107725 | A1* | 4/2009 | Christy | E21B 49/083 175/50 |
| 2012/0211245 | A1 | 8/2012 | Fuhst et al. | |
| 2015/0060083 | A1* | 3/2015 | Romer | F04B 47/06 166/370 |
| 2018/0155991 | A1 | 6/2018 | Arsalan et al. | |
| 2019/0055792 | A1* | 2/2019 | Sui | E21B 17/1014 |

OTHER PUBLICATIONS

GCC Examination Report in Gulf Cooperation Council Appln. No. GC 2019-38102, dated Sep. 3, 2020, 4 pages.

* cited by examiner

THRU-TUBING OPERATIONS

CROSS-REFERENCE TO RELATED APPLICATIONS

This application claims the benefit of U.S. Provisional Application Ser. No. 62/718,061, filed Aug. 13, 2018.

TECHNICAL FIELD

This disclosure relates to well intervention and completion.

BACKGROUND

Problems can develop in a producing well (for example, a hydrocarbon producing well) that can negatively affect operations, production, and ultimately revenue generated. Examples of problems are failure of mechanical equipment, changes in production characteristics, plugging, and increases in injection pressure. After a well begins production, such events may occur, which can require modification of the well in order to achieve production. This modification is called well intervention. Well intervention is any operation carried out on a well (for example, a hydrocarbon well) during its productive life. The operation can alter the state of the well or the well geometry, provide well diagnostics, or manage production of the well.

SUMMARY

This disclosure describes technologies relating to well operations, and more specifically, thru-tubing intervention and thru-tubing completion operations. Certain aspects of the subject matter described here can be implemented as an apparatus including a conduit and an expandable mandrel positioned within the conduit. The conduit is configured to be positioned within a subterranean zone. The conduit has an inner surface and an outer surface. The conduit defines an opening extending from the inner surface to the outer surface. At least a portion of the expandable mandrel is smaller than the opening. A longitudinal length of the expandable mandrel is longer than a longitudinal length of the opening. The expandable mandrel, when actuated, is configured to move in a radial direction with respect to the conduit, such that the portion of the expandable mandrel smaller than the opening moves through the opening and extends beyond the outer surface of the conduit.

This, and other aspects, can include one or more of the following features.

The apparatus can include a well tool coupled to and positioned within the expandable mandrel.

The well tool can include a device selected from a group consisting of a sensor, an energy harvesting tool, a computer, and a flow control device.

The expandable mandrel can include slotted ends configured to mate with the opening to secure a position of the expandable mandrel relative to the conduit.

The expandable mandrel can be coupled to the conduit by a flexible material. The flexible material can be configured to harden to secure a position of the expandable mandrel relative to the conduit.

The inner surface can define an inner volume of the conduit. The expandable mandrel, when actuated, can be configured to move in the radial direction, such that the expandable mandrel is positioned outside the inner volume.

Certain aspects of the subject matter described here can be implemented as a method. An apparatus is deployed through a production tubing of a well formed in a subterranean zone. The apparatus includes a conduit and an expandable mandrel positioned within the conduit. The conduit has an inner surface and an outer surface. The conduit defines an opening extending from the inner surface to the outer surface. At least a portion of the expandable mandrel is smaller than the opening. The apparatus is positioned at a desired location within the subterranean zone. After positioning the apparatus at the desired location, the expandable mandrel is moved in a radial direction with respect to the conduit, such that the portion of the expandable mandrel smaller than the opening moves through the opening and extends beyond the outer surface of the conduit. After moving the expandable mandrel through the opening, a position of the expandable mandrel relative to the conduit is secured.

This, and other aspects, can include one or more of the following features.

The apparatus can include a well tool coupled to and positioned within the expandable mandrel.

A property of the subterranean zone can be measured with the well tool.

Power can be generated within the subterranean zone with the well tool.

Data can be transmitted with the well tool from the subterranean zone to a surface location.

Fluid flow from the subterranean zone can be controlled with the well tool.

Moving the expandable mandrel through the opening can include pushing a tool through the conduit and against the movement to move the expandable mandrel through the opening.

Moving the expandable mandrel through the opening can include flowing a fluid into the conduit to increase pressure within the conduit and move the expandable mandrel through the opening.

Securing the position of the expandable mandrel relative to the conduit can include mating slotted ends of the expandable mandrel to the opening to secure the position of the expandable mandrel relative to the conduit.

The inner surface can define an inner volume of the conduit. Moving the expandable mandrel in the radial direction can include moving the expandable mandrel, such that the expandable mandrel is positioned outside the inner volume.

The well tool can be decoupled from the expandable mandrel. The well tool can be removed from the subterranean zone.

The expandable mandrel can be coupled to the conduit with a flexible material.

Securing the position of the expandable mandrel relative to the conduit can include hardening the flexible material to secure the position of the expandable mandrel relative to the conduit.

The details of one or more implementations of the subject matter of this disclosure are set forth in the accompanying drawings and the description. Other features, aspects, and advantages of the subject matter will become apparent from the description, the drawings, and the claims.

DETAILED DESCRIPTION

The subject matter described in this disclosure can be implemented to install equipment within a well, retrieve equipment from a well, or both, by thru-tubing operations. The apparatus described can be used, for example, for thru-tubing completion operations and for thru-tubing intervention operations. The apparatus described can have an initial outer diameter that is small enough for the apparatus to be run and deployed downhole through the production tubing of a well. In some implementations, the apparatus is expandable, such that once the apparatus has been run to a desired location within the well, the apparatus can expand, for example, by moving an inner expandable mandrel of the apparatus to extend outside the boundary defined by the initial outer diameter of the apparatus. Once expanded, the apparatus does not impose any detectable spatial restriction to the tubular borehole, thereby enabling upstream access and further production of wellbore fluids through the apparatus. For example, once expanded, the inner diameter of the apparatus can be large enough to allow for intervention or completion strings to pass through. Once expanded, the apparatus can also optionally be retrieved to the surface by pulling the expanded apparatus out of the wellbore.

Optimized production and oil recovery are in demand for operators worldwide. Many oil wells are drilled as long horizontal wells and facilitate a larger connectivity with hydrocarbon reservoirs. Often, however, hydrocarbon reservoirs are not homogeneous nor stable over their productive lifetime. Thus, special completions equipment may be necessary to install in order to control and optimize hydrocarbon production. Conventional methods for retrofitting lower completion equipment typically employ workover rigs and pulling out upper completion tubing. This can be costly and time-consuming. On the other hand, thru-tubing operation enables running of equipment through upper completion tubing, thereby eliminating the need for workover rigs and also allowing for lighter rig ups to be used, such as coiled tubing or wireline.

Figure 1A:
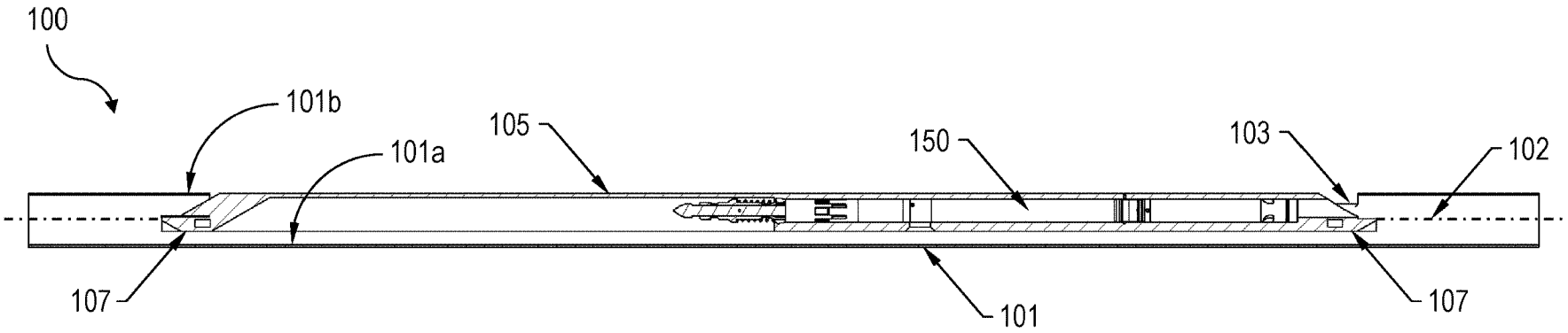
FIGS. 1A and 1B are longitudinal views of an example apparatus.

FIG. 1A shows a longitudinal view of an apparatus 100, according to some implementations. The apparatus 100 includes a conduit 101 and an expandable mandrel 105 positioned within the conduit 101. The conduit is configured to be positioned within a subterranean zone. The subterranean zone can include, for example, a formation, a portion of a formation, or multiple formations in a hydrocarbon-bearing reservoir from which recovery operations can be practiced to recover trapped hydrocarbons. In some implementations, the subterranean zone includes an underground formation of naturally fractured or porous rock containing hydrocarbons (for example, oil, gas, or both). In some implementations, the well can intersect other suitable types of formations, including reservoirs that are not naturally fractured in any significant amount. The apparatus 100 can be positioned and used within a wellbore (formed in the subterranean zone) that has any orientation, such as horizontal, vertical, or otherwise at any other angle that deviates from a horizontal or vertical orientation.

The conduit 101 has an inner surface 101*a* and an outer surface 101*b*. The conduit 101 defines an opening 103 extending from the inner surface 101*a* to the outer surface 101*b*. At least a portion of the expandable mandrel 105 is smaller than the opening 103. Therefore, the portion of the expandable mandrel 105 that is smaller than the opening 103 can fit through the opening 103. The expandable mandrel 105 has a longitudinal length that is longer than a longitudinal length of the opening 103. When actuated, the expandable mandrel 105 can move in a radial direction with respect to the conduit 101 (that is, a direction that is transverse to a longitudinal axis 102 of the conduit 101), such that the portion of the compartment 101 that is smaller than the opening 103 moves through the opening 103 and extends beyond the outer surface 101*b* of the conduit 101.

The apparatus 100 can include a well tool 150 that is coupled to and positioned within the expandable mandrel 105. The well tool 150 can include at least one sensor (for example, a temperature sensor, a pressure sensor, or both), an energy harvesting system (for example, a turbine coupled to an electric generator), a wireless communication system (for example, an acoustic or electromagnetic based transmitting and receiving system), a computer (for example, a microcontroller system with memory), a power storage system (for example, a battery), and a flow control device (for example, a flow valve). The expandable mandrel 105 is configured to move through the opening 103 in a direction transverse to a longitudinal axis 102 of the conduit 101, such that at least a portion of the expandable mandrel 105 extends outside the conduit. The expandable mandrel 105 can be moved, for example, by mechanical force or hydraulic force. For example, a tool (such as a wedge) can be pushed through the conduit 101 and against the expandable mandrel 105 to move the expandable mandrel 105 through the opening 103. As another example, a fluid can be flowed into the conduit 101 to increase pressure within the conduit 101 and move the expandable mandrel 105 through the opening 103. In some implementations, the apparatus 100 includes an inflatable packer positioned within the conduit that can be inflated (for example, by flowing a fluid into the inflatable packer) to move the expandable mandrel 105 through the opening 103. After the expandable mandrel 105 has been moved through the opening 103, the inflatable packer can be deflated and removed.

Figure 1B:
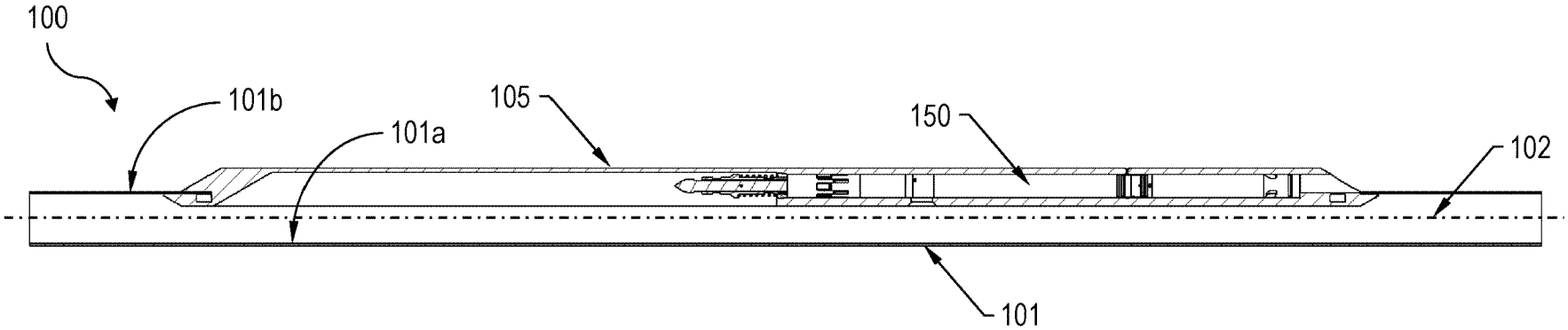

FIG. 1B shows a longitudinal view of the apparatus 100 shown in FIG. 1A, after the apparatus 100 has been expanded. The expandable mandrel 105 can couple to the conduit 101 at the opening 103 of the conduit 101. In some implementations, the expandable mandrel 105 includes slotted ends 107 that are configured to mate with the opening 103 of the conduit 101 to secure the position of the expandable mandrel 105 relative to the conduit 101. In some implementations, the expandable mandrel 105 can mate with a metal-to-metal sealing surface located around the circumference of the opening 103. The mating material can be made of, for example, a ductile metal that is resistant to corrosion from exposure to wellbore fluids. In some implementations, the mating material can deform and upon deformation, permanently seal between the opening 103 of the conduit 101 and the contacting surface of the expandable mandrel 105. The expandable mandrel 105 can include one or more sealing elements configured to form a seal between the conduit 101 and the expandable mandrel 105. In some implementations, the expandable mandrel 105 includes sealing rings around the circumference of the opening 103. The sealing reals can be made of a material that can withstand downhole conditions, for example, the associated downhole temperature, corrosive fluids that may be present downhole, and debris.

Figure 1D:
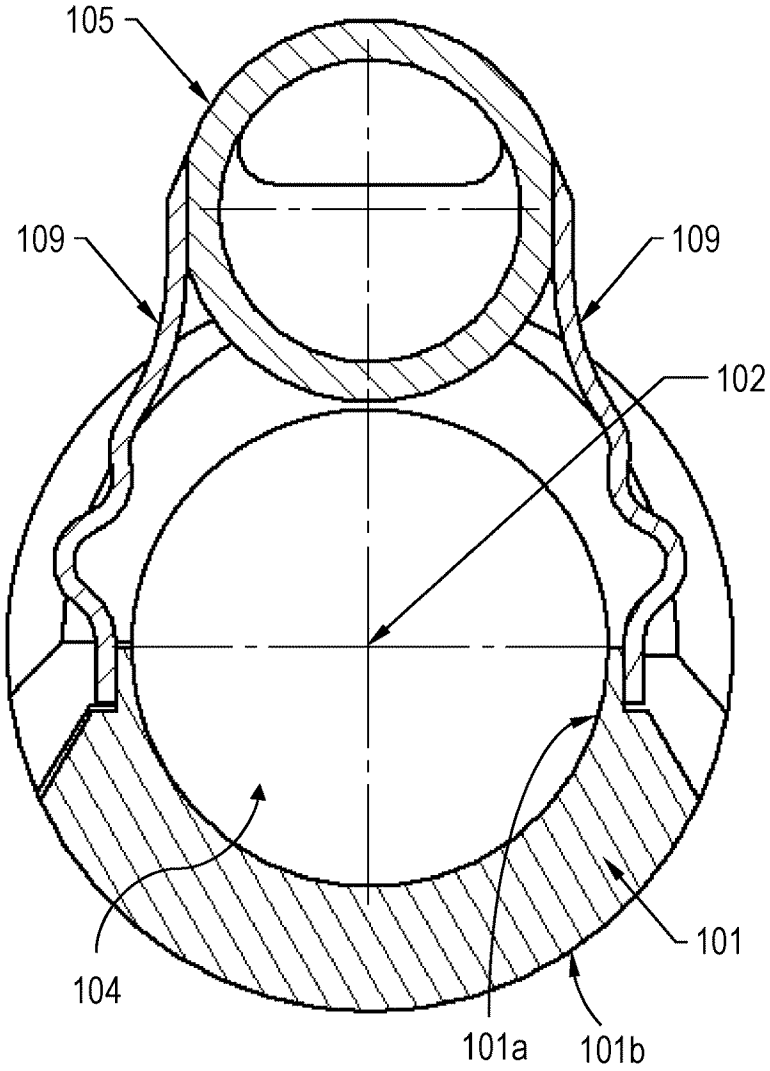
FIGS. 1C and 1D are cross-sectional views of an example apparatus.
Figure 1C:
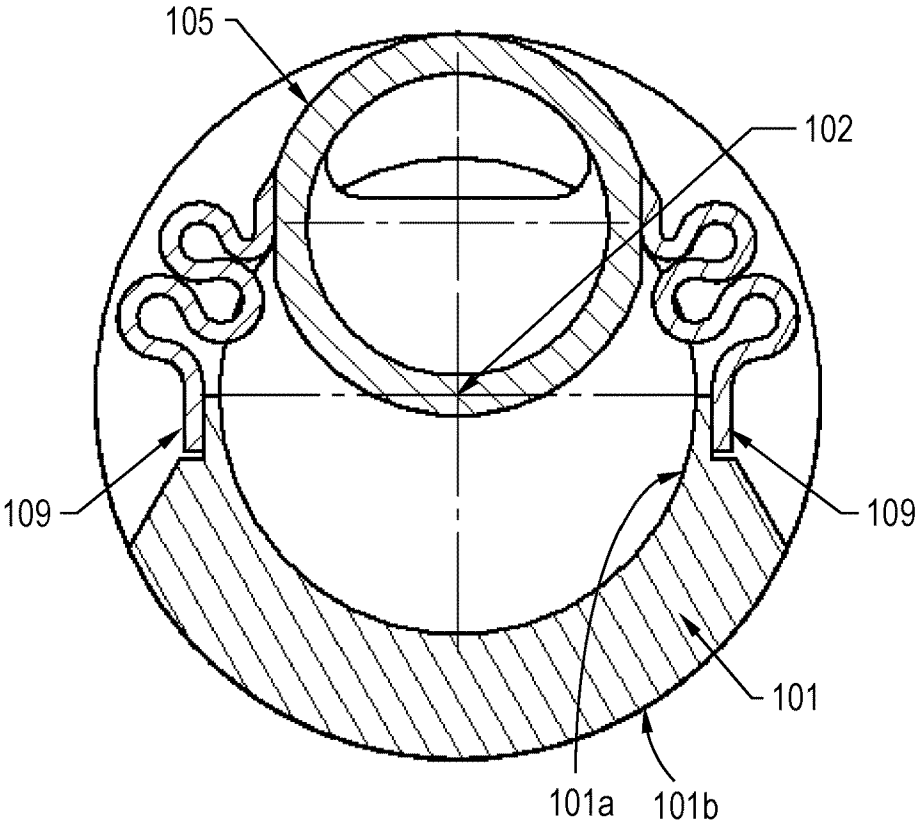

FIG. 1C shows a cross-sectional view of the apparatus 100, according to some implementations. The expandable mandrel 105 can be coupled to the conduit 101 by a flexible material 109, such as rubber, or a permanently deformable material, such as ductile metal. In some implementations, the flexible material 109 is hardened after the expandable mandrel 105 has been moved through the opening 103, so that the position of the expandable mandrel 105 relative to the conduit 101 can be secured. When the flexible material 109 is made of ductile metal, the flexible material 109 can be folded to compress the flexible material 109. The flexible material 109 can be strained to its material yield point in the direction opposite of which the expandable mandrel 105 is to be expanded when deployed in the wellbore. In such implementations, the apparatus 100 can include a retaining device configured to secure the expandable mandrel 105 in an unexpanded state within the opening 103. The retaining device can be configured to withstand the spring force exerted by the flexible material 109 when the flexible material 109 is compressed. In some implementations, the retaining device is provided in the form of shear studs oriented along the longitudinal axis 102 of the conduit 101. When the expandable mandrel 105 is expanded (for example, by mechanical or hydraulic force), the shear studs can shear off and release the expandable mandrel 105, such that the expandable mandrel 105 can move through the opening 103.

In some implementations, the flexible material 109 includes a hardening fluid that can be hardened after the expandable mandrel 105 has been moved through the opening 103, so that the position of the expandable mandrel 105 relative to the conduit 101 can be secured. In some implementations, a hardening fluid is flowed into the flexible material 109 after the expandable mandrel 105 has been moved through the opening 103, and then the hardening fluid is allowed to harden, so that the position of the expandable mandrel 105 relative to the conduit 101 can be secured. The hardening fluid can be a fluid that naturally hardens after some time. The hardening fluid can be a fluid that hardens in response to an external stimulus, such as heat or pressure. In some implementation, the pressure of the wellbore, the temperature of the wellbore, or both the pressure and the temperature of the wellbore cause the hardening fluid to harden within the flexible material 109. The hardening fluid can be, for example, a cement, a thermoset (also referred as thermosetting plastic or thermosetting polymer), or a resin. Hardening of the hardening fluid can include a chemical reaction, cross-linking, homopolymerization, or a combination of these. In some implementations, a hardening agent (or a curing agent) can be flowed into the flexible material 109, and the hardening agent can react with the hardening fluid to harden (or cure) the hardening fluid. In some implementations, the hardening agent and the hardening fluid are flowed into the flexible material 109 simultaneously. In some implementations, the hardening agent and the hardening fluid are flowed into the flexible material 109 separately. In some implementations, the flexible material 109 contains the hardening fluid before the apparatus 100 is positioned within the well. In some implementations, fluid is flowed into the flexible material 109, for example, by a pump after the apparatus 100 is positioned within the well.

FIG. 1D shows a cross-sectional view of the apparatus 100 shown in FIG. 1C, after the apparatus 100 has been expanded. The inner surface 101*b* of the conduit 101 can define an inner volume 104 of the conduit 101. In some implementations (and as shown in FIG. 1D), after the apparatus 100 has been expanded (that is, the expandable mandrel 105 has been moved through the opening 103), the expandable mandrel 105 is positioned outside the inner volume 104. The position of the expandable mandrel 105 relative to the conduit 101 can then be secured, so that the inner volume 104 of the conduit 101 remains unrestricted by the expandable mandrel 105. In some implementations, a portion of the expandable mandrel 105 can be positioned within the inner volume 104.

Figure 2C:
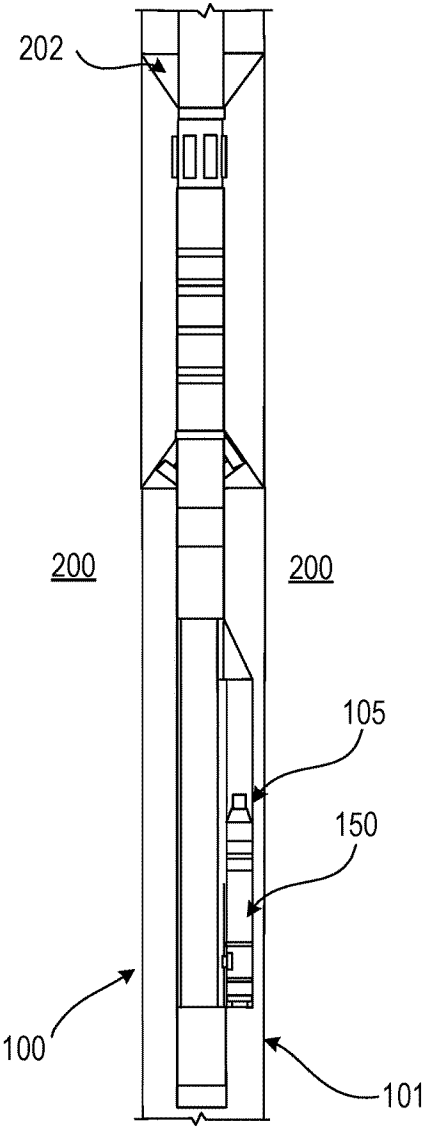
FIGS. 2A, 2B, and 2C show an example apparatus within an example subterranean zone.
Figure 2B:
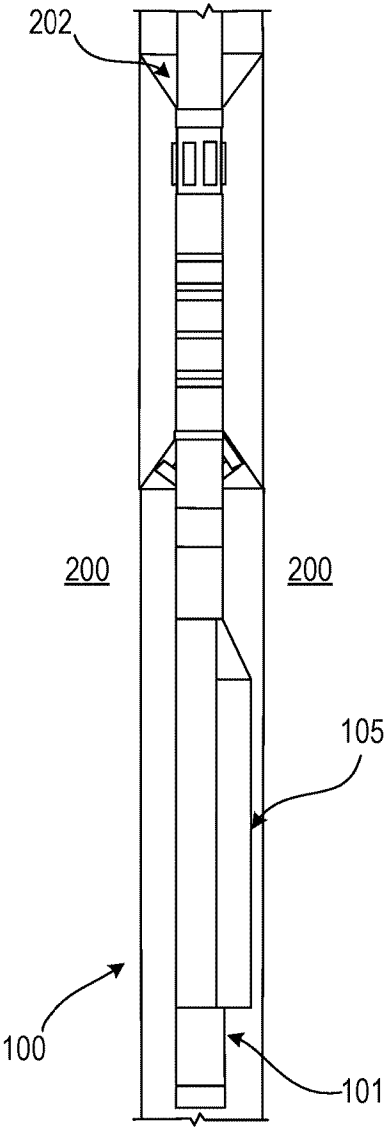
Figure 2A:
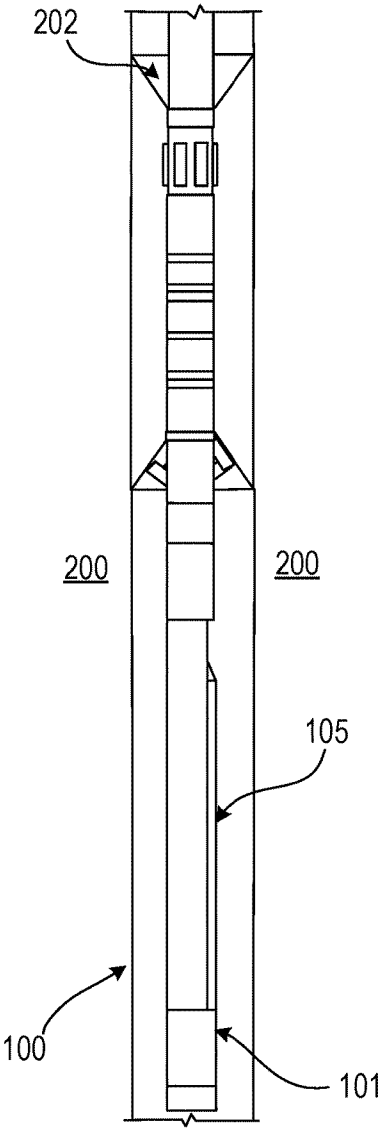

FIGS. 2A, 2B, and 2C show the apparatus 100, according to some implementations, positioned within an example subterranean zone 200. The apparatus 100 can be deployed downhole to a desired location within the subterranean zone 200. The apparatus 100 can be supported (that is, secured or anchored) by a landing zone 202 formed within the subterranean zone. FIG. 2A shows the apparatus 100 positioned within the subterranean zone 200 and supported by the landing zone 202, before the apparatus 100 has expanded. FIG. 2B shows the apparatus 100 positioned within the subterranean zone 200 and supported by the landing zone 202, after the apparatus 100 has expanded. FIG. 2C shows a cross-sectional view of the apparatus 100 positioned within the subterranean zone 200 and supported by the landing zone 202, after the apparatus 100 has expanded. As shown in FIG. 2C, the apparatus 100 can include a well tool 150 coupled to and positioned within an expandable mandrel 105.

Figure 3A:
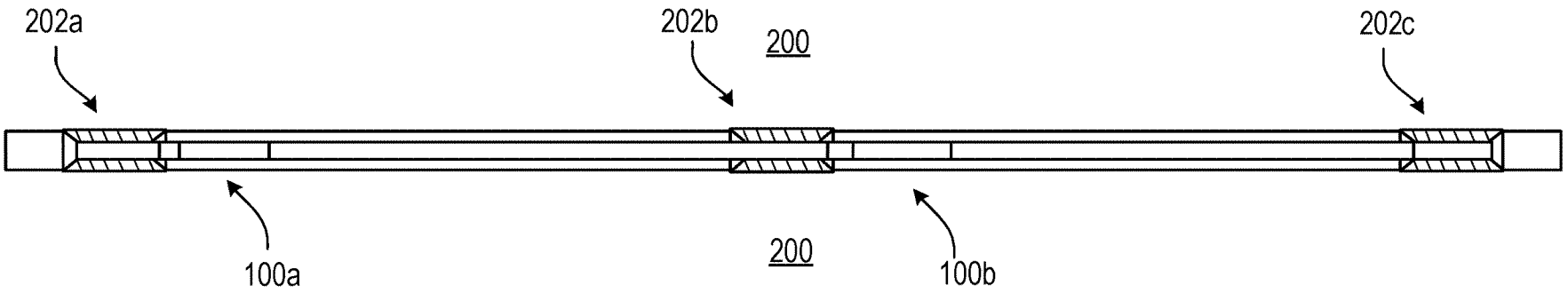
FIGS. 3A and 3B are schematic diagrams of an example system.
Figure 3B:
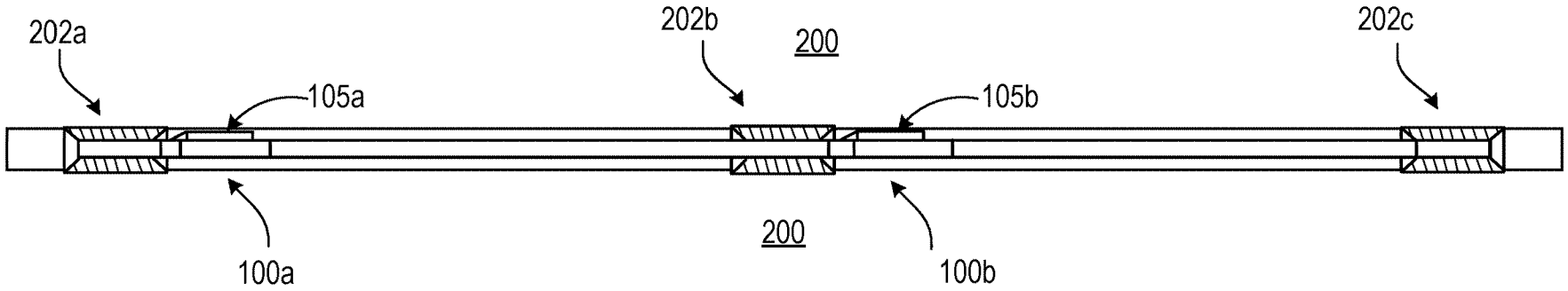

FIGS. 3A and 3B are schematic diagrams of a well completion system, according to some implementations, positioned within a subterranean zone 200. The well completion system can include multiple apparatuses 100*a* and 100*b* supported by multiple landing zones 202*a* and 202*b*, respectively. The apparatuses 100*a* and 100*b* can be substantially the same as the apparatus 100 described before. For example, both apparatuses 100*a* and 100*b* can be the same implementation of the apparatus 100 described before. As another example, apparatus 100*a* can be a certain implementation of the apparatus 100 described before, and apparatus 100*b* can be another implementation of the apparatus 100 described before. Additional apparatuses (similar to or the same as the apparatus 100) can be deployed downhole and supported by additional landing zones (such as the landing zone 202*c*). Each apparatus can be provided in a variety of configures depending on the desired application. Some non-limiting examples of applications include isolated water producing zones, high permeability hydrocarbon producing zones, and gas producing zones.

The wellbore can include multiple producing zones. A producing zone (often called a compartment in the wellbore) can be defined as the zone between two landing zones (for example, between landing zones 202*a* and 202*b*). By including a flow control device in the well tool 150 positioned within the producing zones, production control can be achieved, thereby enabling choking and shut in of the respective producing zone. This feature can improve hydrocarbon recovery from the well.

As mentioned before, the apparatus 100 can allow access of intervention or completion tools when the apparatus 100 is expanded. Such tools can be used to retrieve well tools (such as well tool 150), replace well tools, or both. For example, a kick-over intervention tool can be used to retrieve and replace gas lift tools that are located in side pocket mandrels (such as the expandable mandrel 105). By enabling upstream access of tools through the expanded apparatus 100, service and modification of well tools and well completion system architecture can be achieved even for multiple installations of the apparatus 100 in the wellbore.

Figure 4:
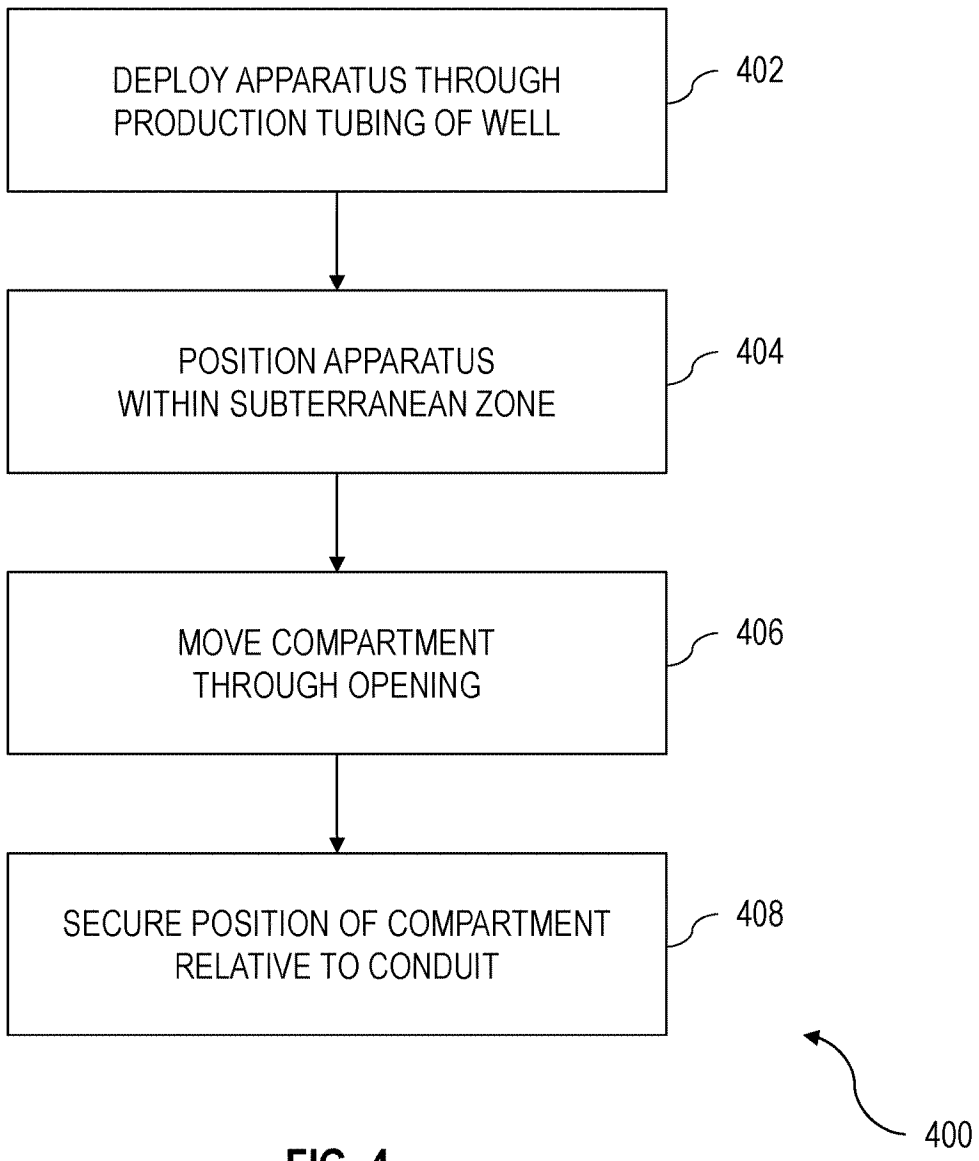
FIG. 4 is a flow chart of an example method for a thru-tubing well operation.

FIG. 4 is a flow chart of an example method 400 for thru-tubing well operation. The method 400 can be applicable, for example, to the apparatus 100. At step 402, the apparatus 100 is deployed through a production tubing of a well formed in a subterranean zone 200. As mentioned before, the apparatus 100 includes a conduit 101 defining an opening 103 on a lateral side of the conduit 101 and an expandable mandrel 105 positioned within the conduit 101. The apparatus 100 can include a well tool 150 coupled to and positioned within the expandable mandrel 105. At step 404, the apparatus 100 is positioned at a desired location within the subterranean zone 200. The apparatus 100 can be secured by a landing zone 202, so that the apparatus 100 remains in place at the desired location within the subterranean zone 200.

After positioning the apparatus 100 within the subterranean zone at step 404, the expandable mandrel 105 is moved through the opening in a direction transverse to a longitudinal axis 102 of the conduit 101 at step 406, such that at least a portion of the expandable mandrel 105 extends outside the conduit 101. The expandable mandrel 105 can be moved by mechanical force at step 406 by pushing a tool (such as a wedge) through the conduit 101 and against the expandable mandrel 105 to move the expandable mandrel 105 through the opening 103. The expandable mandrel 105 can be moved by hydraulic force at step 406 by flowing a fluid into the conduit 101 to increase pressure within the conduit 101 and move the expandable mandrel 105 through the opening 103.

After moving the expandable mandrel 105 at step 406, a position of the expandable mandrel 105 relative to the conduit 101 is secured at step 408. For example, the position of the expandable mandrel 105 can be secured at step 408 by mating slotted ends 107 of the expandable mandrel 105 to the opening 103. The expandable mandrel 105 can be coupled to the conduit 101. For example, the expandable mandrel 105 is coupled to the conduit 101 with a flexible material 109. The flexible material 109 can be hardened to secure the position of the expandable mandrel 105 relative to the conduit 101 at step 408. In some implementations, the expandable mandrel 105 can be moved through the opening 103, such that the expandable mandrel 105 is positioned outside an inner volume 104 defined by an inner surface 101*b* of the conduit 101.

The well tool 150 can be used to measure a property of the subterranean zone (such as pressure or temperature). The well tool 150 can be used to generate power within the subterranean zone. The well tool 150 can be used to transmit data from the subterranean zone to a surface location. The well tool 150 can be used to control fluid flow from the subterranean zone into the well, for example, by commands received from a surface location or in response to a measured downhole condition. The well tool 150 can also be retrieved, for example, in the case that the well tool 150 malfunctions and needs to be repaired, replaced, or upgraded. In such cases, the well tool 150 can be decoupled from the expandable mandrel 105, and the well tool 150 can be removed from the subterranean zone (as described before). The well tool 150 can then be repaired and re-run downhole through the conduit 101 to be re-coupled to the expandable mandrel 105 within the subterranean zone, or a new well tool can be run downhole through the conduit 101 to be coupled to the expandable mandrel 105 within the subterranean zone.

Figure 5:
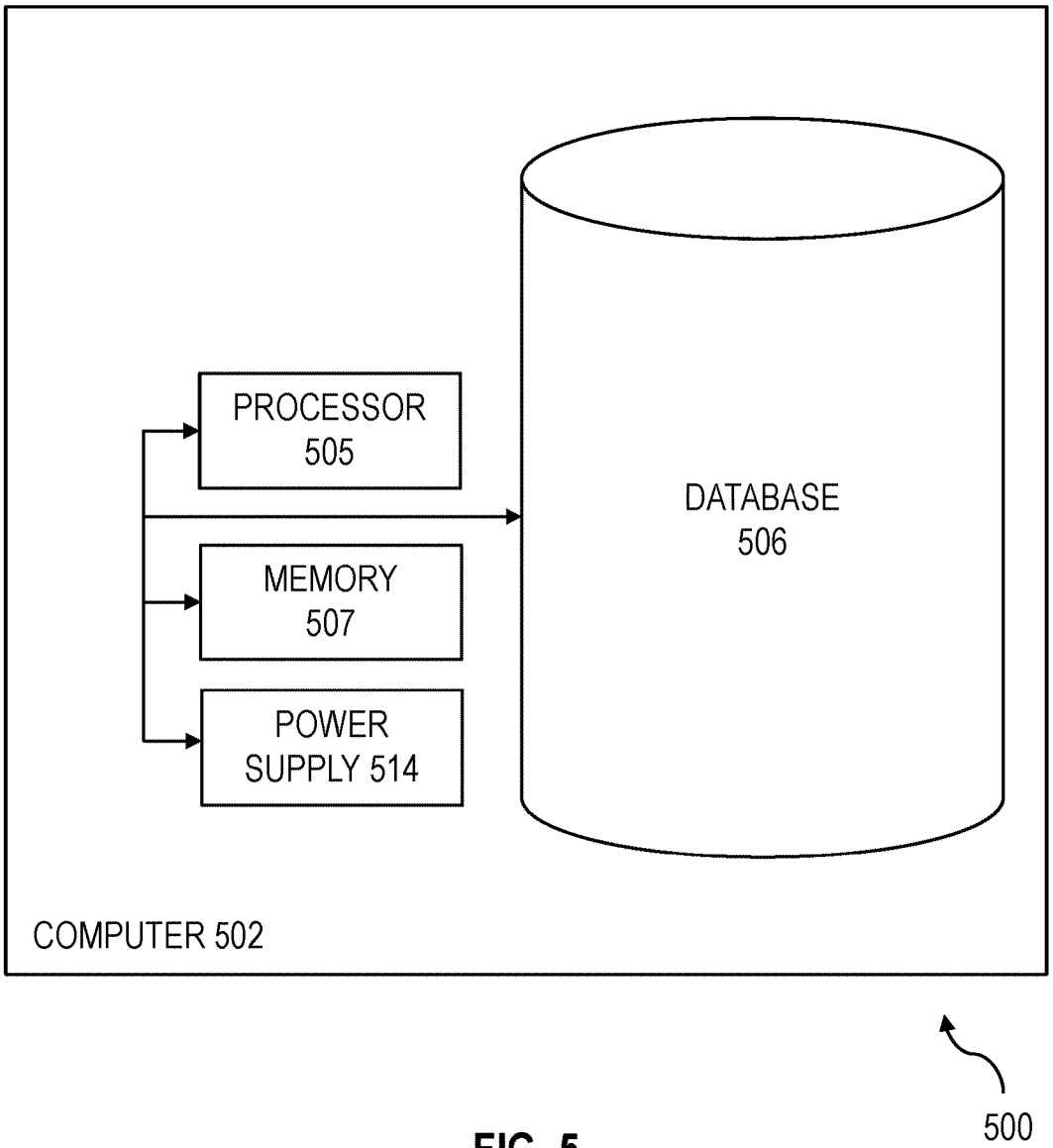
FIG. 5 is a block diagram of an example computer system.

FIG. 5 is a block diagram of an example computer system 500 used to provide computational functionalities associated with described algorithms, methods, functions, processes, flows, and procedures, as described in this disclosure, according to some implementations. For example, the well tool 150 can include the computer system 500. The computer 502 includes a processor 505. Although illustrated as a single processor 505 in FIG. 5, two or more processors may be used according to particular needs, desires, or particular implementations of the computer 502. Generally, the processor 505 executes instructions and manipulates data to perform the operations of the computer 502 and any algorithms, methods, functions, processes, flows, and procedures as described in this specification.

The computer 502 can also include a database 506 that can store data for the computer 502 or other components (or a combination of both) that can be connected to the network. Although illustrated as a single database 506 in FIG. 5, two or more databases (of the same or combination of types) can be used according to particular needs, desires, or particular implementations of the computer 502 and the described functionality. While database 506 is illustrated as an integral component of the computer 502, database 506 can be external to the computer 502.

The computer 502 also includes a memory 507 that can store data for the computer 502 or other components (or a combination of both) that can be connected to the network. Although illustrated as a single memory 507 in FIG. 5, two or more memories 507 (of the same or combination of types) can be used according to particular needs, desires, or particular implementations of the computer 502 and the described functionality. While memory 507 is illustrated as an integral component of the computer 502, memory 507 can be external to the computer 502. The memory 507 can be a transitory or non-transitory storage medium.

The memory 507 stores computer-readable instructions executable by the processor 505 that, when executed, cause the processor 505 to perform operations, such as transmitting data (for example, temperature or pressure data from one or more sensors of the well tool 150) from the subterranean zone to a surface location. The computer 502 can also include a power supply 514. The power supply 514 can include a rechargeable or non-rechargeable battery that can be configured to be either user- or non-user-replaceable. The power supply 514 can be hard-wired. There may be any number of computers 502 associated with, or external to, a computer system containing computer 502, each computer 502 communicating over the network. Further, the term "client," "user," "operator," and other appropriate terminology may be used interchangeably, as appropriate, without departing from the scope of this specification. Moreover, this specification contemplates that many users may use one computer 502, or that one user may use multiple computers 502.

In this disclosure, the terms "a," "an," or "the" are used to include one or more than one unless the context clearly dictates otherwise. The term "or" is used to refer to a nonexclusive "or" unless otherwise indicated. The statement "at least one of A and B" has the same meaning as "A, B, or A and B." In addition, it is to be understood that the phraseology or terminology employed in this disclosure, and not otherwise defined, is for the purpose of description only and not of limitation. Any use of section headings is intended to aid reading of the document and is not to be interpreted as limiting; information that is relevant to a section heading may occur within or outside of that particular section.

In this disclosure, "approximately" means a deviation or allowance of up to 10 percent (%) and any variation from a mentioned value is within the tolerance limits of any machinery used to manufacture the part.

Values expressed in a range format should be interpreted in a flexible manner to include not only the numerical values explicitly recited as the limits of the range, but also to include all the individual numerical values or sub-ranges encompassed within that range as if each numerical value and sub-range is explicitly recited. For example, a range of "0.1% to about 5%" or "0.1% to 5%" should be interpreted to include about 0.1% to about 5%, as well as the individual values (for example, 1%, 2%, 3%, and 4%) and the sub-ranges (for example, 0.1% to 0.5%, 1.1% to 2.2%, 3.3% to 4.4%) within the indicated range. The statement "X to Y" has the same meaning as "about X to about Y," unless indicated otherwise. Likewise, the statement "X, Y, or Z" has the same meaning as "about X, about Y, or about Z," unless indicated otherwise. "About" can allow for a degree of variability in a value or range, for example, within 10%, within 5%, or within 1% of a stated value or of a stated limit of a range.

While this disclosure contains many specific implementation details, these should not be construed as limitations on the scope of the subject matter or on the scope of what may be claimed, but rather as descriptions of features that may be specific to particular implementations. Certain features that are described in this disclosure in the context of separate implementations can also be implemented, in combination, in a single implementation. Conversely, various features that are described in the context of a single implementation can also be implemented in multiple implementations, separately, or in any suitable sub-combination. Moreover, although previously described features may be described as acting in certain combinations and even initially claimed as such, one or more features from a claimed combination can, in some cases, be excised from the combination, and the claimed combination may be directed to a sub-combination or variation of a sub-combination.

Particular implementations of the subject matter have been described. Other implementations, alterations, and permutations of the described implementations are within the scope of the following claims as will be apparent to those skilled in the art. While operations are depicted in the drawings or claims in a particular order, this should not be understood as requiring that such operations be performed in the particular order shown or in sequential order, or that all illustrated operations be performed (some operations may be considered optional), to achieve desirable results.

Accordingly, the previously described example implementations do not define or constrain this disclosure. Other changes, substitutions, and alterations are also possible without departing from the spirit and scope of this disclosure.

What is claimed is:

1. An apparatus comprising:

a conduit configured to be positioned within a subterranean zone, the conduit having an inner surface and an outer surface, the conduit defining an opening extending from the inner surface to the outer surface; and an extensible mandrel positioned within the conduit and coupled to the conduit by a flexible material, wherein:

at least a portion of the extensible mandrel is smaller than the opening;

the extensible mandrel, when actuated, is configured to move in a radial direction with respect to the conduit, such that the portion of the extensible mandrel smaller than the opening moves through the opening and extends beyond the outer surface of the conduit; and the flexible material is configured to harden to secure a position of the extensible mandrel relative to the conduit.

2. The apparatus of claim 1, further comprising a well tool coupled to and positioned within the extensible mandrel.

3. The apparatus of claim 2, wherein the well tool comprises a device selected from a group consisting of a sensor, an energy harvesting system, a wireless communication system, a power storage system, a microcontroller system with memory, and a flow control device.

4. The apparatus of claim 3, wherein the extensible mandrel comprises slotted ends configured to mate with the opening to secure a position of the extensible mandrel relative to the conduit.

5. The apparatus of claim 1, wherein the inner surface defines an inner volume of the conduit, and the extensible mandrel, when actuated, is configured to move in the radial direction, such that the extensible mandrel is positioned outside the inner volume.

6. A method comprising:

deploying an apparatus through a production tubing of a well formed in a subterranean zone, the apparatus comprising:

a conduit having an inner surface and an outer surface, the conduit defining an opening extending from the inner surface to the outer surface; and an extensible mandrel positioned within the conduit and coupled to the conduit by a flexible material, wherein at least a portion of the extensible mandrel is smaller than the opening;

positioning the apparatus at a desired location within the subterranean zone;

after positioning the apparatus at the desired location, moving the extensible mandrel in a radial direction with respect to the conduit, such that the portion of the extensible mandrel smaller than the opening moves through the opening and extends beyond the outer surface of the conduit; and after moving the extensible mandrel through the opening, hardening the flexible material to secure a position of the extensible mandrel relative to the conduit.

7. The method of claim 6, wherein the apparatus comprises a well tool coupled to and positioned within the extensible mandrel.

8. The method of claim 7, further comprising measuring, with the well tool, a property of the subterranean zone.

9. The method of claim 7, further comprising generating, with the well tool, power within the subterranean zone.

10. The method of claim 7, further comprising transmitting, with the well tool, data from the subterranean zone to a surface location.

11. The method of claim 7, further comprising controlling, with the well tool, fluid flow from the subterranean zone.

12. The method of claim 7, wherein moving the extensible mandrel through the opening comprises flowing a fluid into the conduit to increase pressure within the conduit and move the extensible mandrel through the opening.

13. The method of claim 7, wherein securing the position of the extensible mandrel relative to the conduit comprises mating slotted ends of the expandable extensible mandrel to the opening to secure the position of the extensible mandrel relative to the conduit.

14. The method of claim 7, wherein the inner surface defines an inner volume of the conduit, and moving the extensible mandrel in the radial direction comprises moving the extensible mandrel, such that the extensible mandrel is positioned outside the inner volume.

15. The method of claim 7, further comprising:

decoupling the well tool from the extensible mandrel; and removing the well tool from the subterranean zone.

* * * * *